US005329764A

United States Patent [19]

Hamburg et al.

[11] Patent Number: 5,329,764

[45] Date of Patent: Jul. 19, 1994

[54] AIR/FUEL FEEDBACK CONTROL SYSTEM

[75] Inventors: Douglas R. Hamburg, Bloomfield; Jeffrey A. Cook, Dearborn; Eleftherios M. Logothetis, Birmingham, all of Mich.

[73] Assignee: Ford Motor Company, Dearborn, Mich.

[21] Appl. No.: 3,031

[22] Filed: Jan. 11, 1993

[51] Int. Cl.[5] ..... F02B 19/16

[52] U.S. Cl. ..... 60/285; 60/274; 123/703

[58] Field of Search ..... 123/703, 672; 60/276, 60/285, 274

[56] References Cited

U.S. PATENT DOCUMENTS 4,194,471 3/1980 Baresel ..... 60/276
4,789,939 12/1988 Hamburg ..... 364/431.05
4,878,473 11/1989 Nakaniwa et al. ..... 123/703
4,915,080 4/1990 Nakaniwa et al. ..... 123/489
4,988,428 1/1991 Iwakiri et al. ..... 204/406

FOREIGN PATENT DOCUMENTS 125941 5/1990 Japan ..... 123/691

*Primary Examiner*—Noah P. Kamen
*Attorney, Agent, or Firm*—Allan J. Lippa; Roger L. May

[57] ABSTRACT

An air/fuel control system for internal combustion engines having three-way (NOx, CO, and HC) catalytic converters. A feedback variable is generated by subtracting the normalized output of a nitrogen oxide sensor from the normalized output of a combined HC/CO sensor. The zero crossing point of the feedback variable identifies the operating point for optimal conversion efficiency of the catalytic converter and is used to trim liquid fuel delivery for maintaining optimal conversion efficiency.

7 Claims, 4 Drawing Sheets

MAF
MAP
T
rpm
HC/CO
NOx
fpw
OUTPUT PORTS
MPU
ROM
RAM
KAM
INPUT PORTS
HC/CO
NOx
MAF
MAP
rpm
T
10
12
14
16
18
20
22
28
32
36
40
42
46
50
54
56
58
62
76
80
82
84

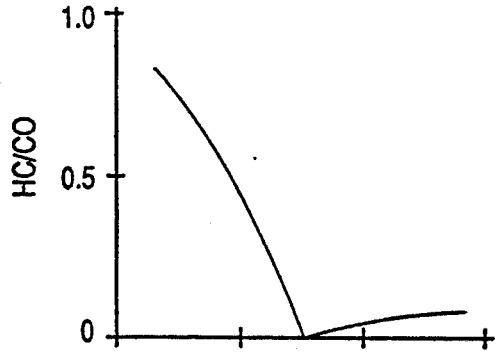
FIG.3A
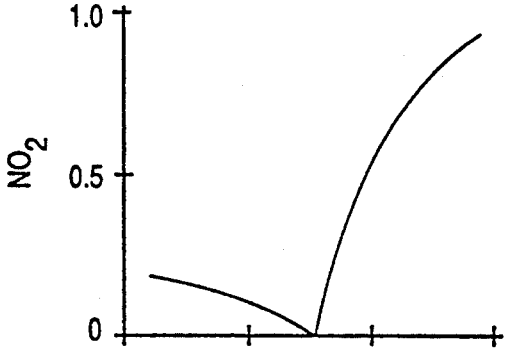
FIG.3B
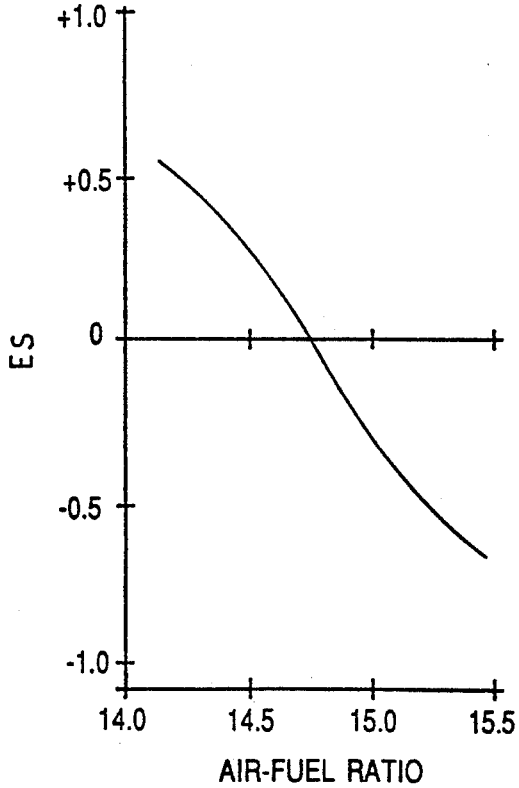
FIG.3C
FIG.3D

AIR/FUEL FEEDBACK CONTROL SYSTEM

BACKGROUND OF THE INVENTION

The field of the invention relates to air/fuel control systems for internal combustion engines equipped with catalytic converters.

It is known to correct fuel delivered to an internal combustion engine in response to feedback from a two-state (rich/lean) exhaust gas oxygen sensor. A proportional plus integral feedback controller responsive to the sensor output will force the engine's operating air/fuel ratio to oscillate or hunt around the sensor switch point. If the sensor switch point actually corresponds to stoichiometric combustion, the efficiency of a three-way catalytic converter (NOx, CO, and HC) will be optimized.

Feedback systems are also known in which the exhaust sensor is placed downstream of the catalyst where exhaust gases are near equilibrium and average engine air/fuel operation is more likely to average at stoichiometry.

The inventors herein have recognized that the operating window for maximum efficiency of a catalytic converter does not always correspond to the switch point the oxygen gas sensor used in a feedback control system. Even when a relatively good correspondence is initially achieved, aging and temperature effects of the oxygen sensor may cause a variance between the sensor indication and the actual conversion window of the catalytic converter.

SUMMARY OF THE INVENTION

An object of the invention herein is to provide engine air/fuel operation at the specific operating window of the particular catalytic converter coupled to the engine.

The above object is achieved, and disadvantages of prior approaches overcome, by providing both a control system and method for optimizing conversion efficiency of a catalytic converter positioned in the engine exhaust. In one particular aspect of the invention, the control system comprises a first sensor positioned downstream of the catalytic converter for providing a first electrical signal having an amplitude related to quantity of nitrogen oxides in the exhaust; a second sensor positioned downstream of the catalytic converter for providing a second electrical signal having an amplitude related to quantity of at least one combustible exhaust by-product other than nitrogen oxides; and fuel control means for delivering fuel to the engine in relation to quantity of air inducted into the engine and a desired air/fuel ratio and a feedback variable derived from the first electrical signal and the second electrical signal.

An advantage of the above aspect of the invention is that engine air/fuel operation is adjusted in response to identification of the converter's actual operating window. Optimum conversion efficiency is thereby achieved.

BRIEF DESCRIPTION OF THE DRAWINGS

The object and advantages of the invention described above and others will be more clearly understood by reading an example of an embodiment in which the invention is used to advantage with reference to the attached drawings wherein:

FIGS. 3A–3D represents various electrical waveforms generated by a portion of the embodiment shown in FIG. 1 and further described in FIG. 2.

DESCRIPTION OF AN EMBODIMENT

Figure 1:
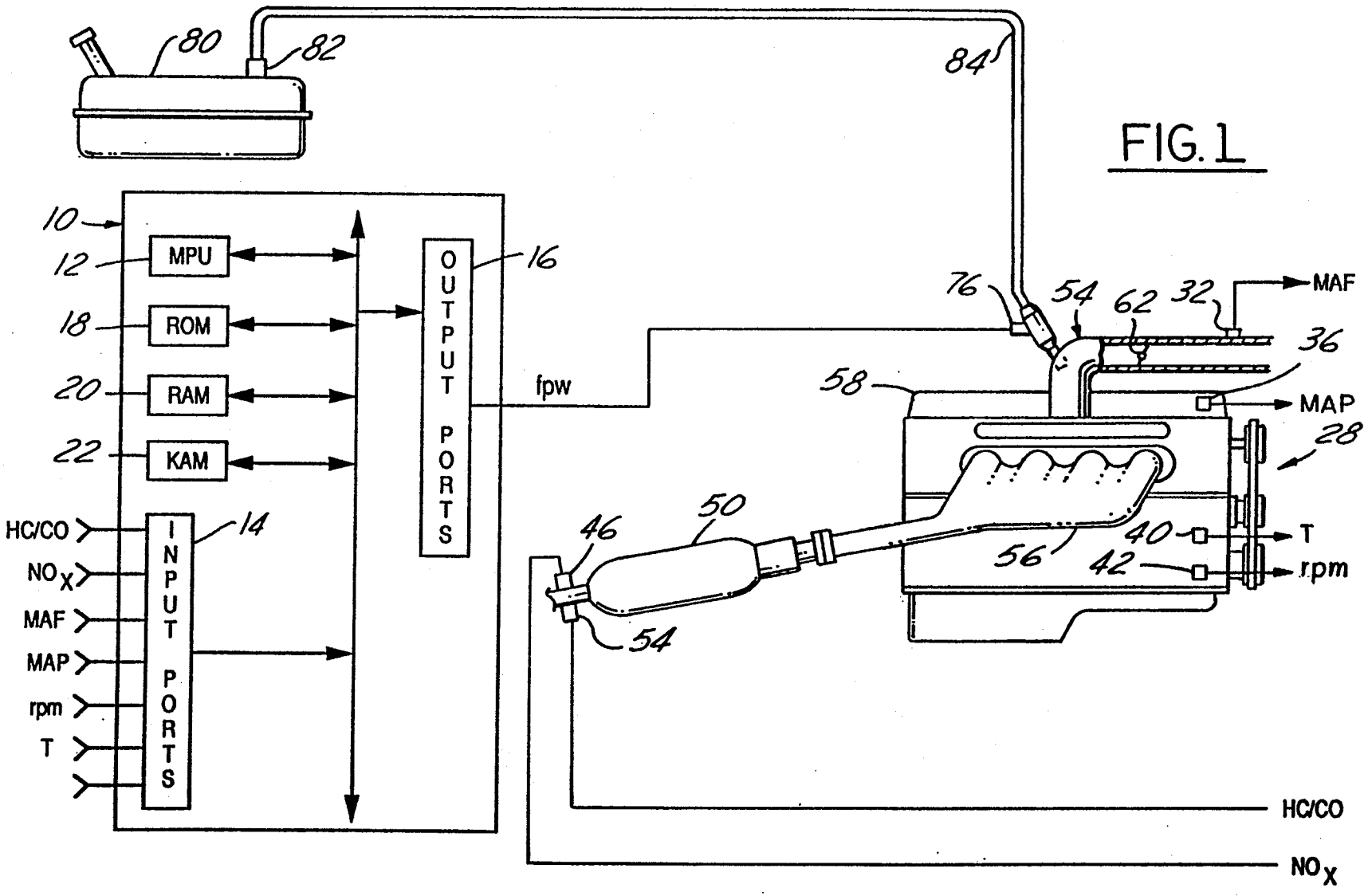
FIG. 1 is a block diagram of an embodiment wherein the invention is used to advantage.

Controller 10 is shown in the block diagram of FIG. 1 as a conventional microcomputer including: microprocessor unit 12; input ports 14; output ports 16; read-only memory 18, for storing the control program; random access memory 20 for temporary data storage which may also be used for counters or timers; keep-alive memory 22, for storing learned values; and a conventional data bus.

Controller 10 is shown receiving various signals from sensors coupled to engine 28 including; measurement of inducted mass airflow (MAF) from mass airflow sensor 32; manifold pressure (MAP), commonly used as an indication of engine load, from pressure sensor 36; engine coolant temperature (T) from temperature sensor 40; indication of engine speed (rpm) from tachometer 42; indication of nitrogen oxides (NOx) from nitrogen oxide sensor 46 positioned in the engine exhaust downstream of three-way catalytic converter 50; and a combined indication of both HC and CO from sensor 54 positioned in the engine exhaust downstream of catalytic converter 50. In this particular example, sensor 46 is a nitrogen dioxide SAW-Chemosensor described in IEEE Transactions on Ultrasonics, Ferroelectrics, and Frequency Control, VOL. UFFC-34, NO. 2, Mar. 19, 1987, pgs. 148–155 and made by Xensor Integration and TNO/PML of the Netherlands. Sensor 54 is a catalytic-type sensor produced by Sonoxco Inc. of Mountain View, California. The invention may also be used to advantage with separate measurements of HC and CO by separate hydrocarbon and carbon monoxide sensors.

Intake manifold 58 of engine 28 is shown coupled to throttle body 54 having primary throttle plate 62 positioned therein. Throttle body 54 is also shown having fuel injector 76 coupled thereto for delivering liquid fuel in proportion to the pulse width of signal fpw from controller 10. Fuel is delivered to fuel injector 76 by a conventional fuel system including fuel tank 80, fuel pump 82, and fuel rail 84.

Figure 2:
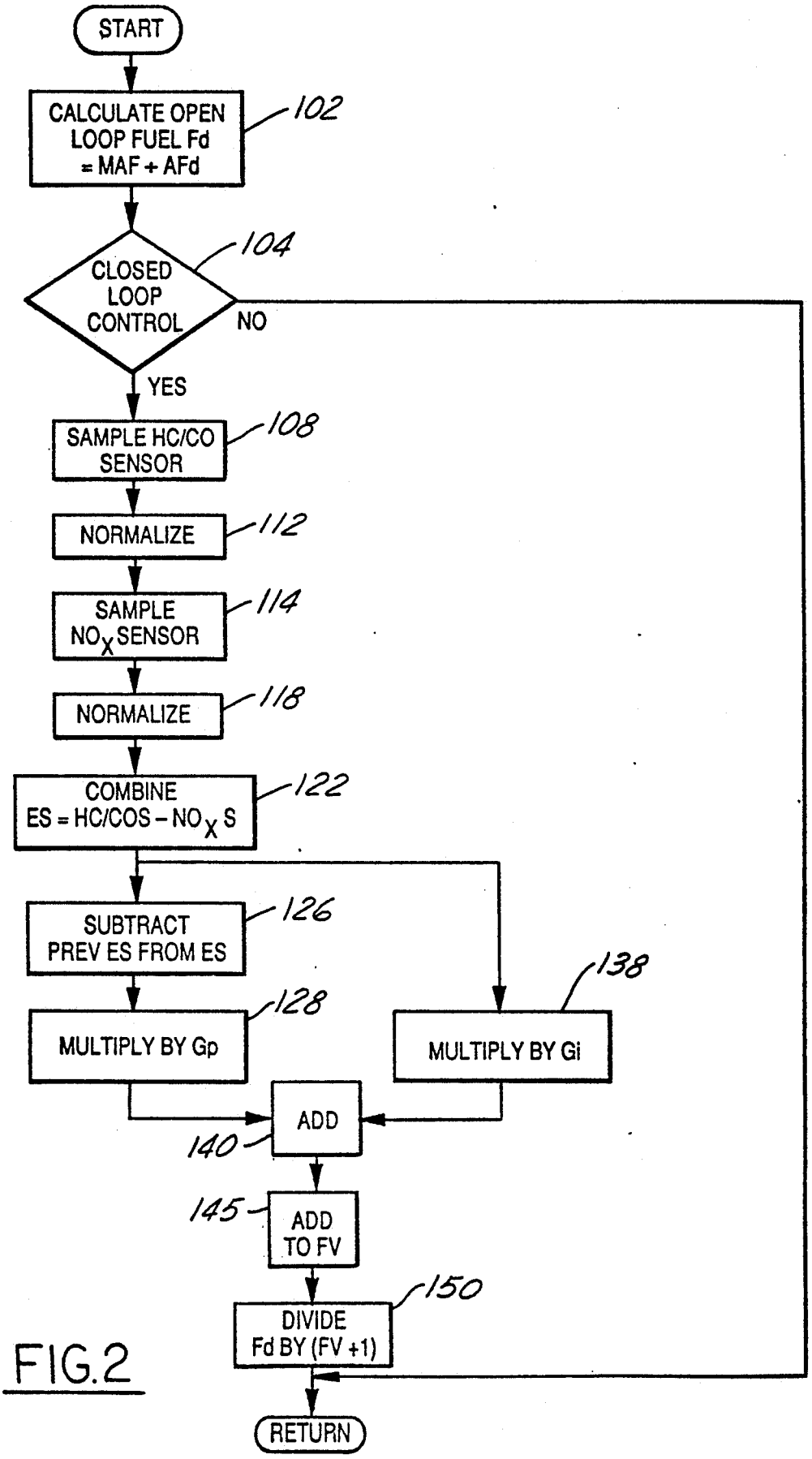
FIG. 2 is a high level flowchart of various operations performed by a portion of the embodiment represented in FIG. 1.

Referring now to FIG. 2, a flowchart of the liquid fuel delivery routine including feedback correction executed by controller 10 is now described. Fuel desired (Fd) for open-loop engine operation is first determined during step 102 by dividing measurement of mass airflow MAF by a reference or desired air/fuel ratio (AFd). A determination is then made whether closed-loop air/fuel control is to be commenced (step 104) by monitoring engine operation conditions such as temperature. When closed loop control commences, sensor 54 is sampled (step 108) which, in this particular example, provides an output signal related to the quantity of both HC and CO in the engine exhaust.

The HC/CO output of sensor 54 is normalized with respect to engine speed and load during step 112. A graphical representation of this normalized output is presented in FIG. 3A. As described in greater detail later herein, the zero level of the normalized HC/CO output signal is correlated with the operating window, or point of maximum conversion efficiency, of catalytic converter 50.

Continuing with FIG. 2, nitrogen oxide sensor 46 is sampled during step 114 and normalized with respect to engine speed and load during step 118. A graphical representation of the normalized output of nitrogen oxide sensor 46 is presented in FIG. 3B. The zero level of the normalized nitrogen oxide signal is correlated with the operating window of catalytic converter 50 resulting in maximum conversion efficiency.

During step 122 the normalized output of nitrogen oxide sensor 46 is subtracted from the normalized output of HC/CO sensor 54 to generate combined emission signal ES. The zero crossing point of emission signal ES (see FIG. 3D) corresponds to the actual operating window for maximum conversion efficiency of catalytic converter 50. As described below with reference to process steps 126 to 150, emission signal ES is processed in a proportional plus integral controller to generate feedback variable FV for trimming the liquid fuel delivered to engine 28.

Referring first to step 126, the value of emission signal ES from the previous background loop of microcomputer 10 is subtracted from the present value of ES, and the result is multiplied by the proportional gain Gp (step 128) to form an incremental proportional feedback signal. Similarly, the present value of ES is multiplied by the integral gain Gi (step 138) to form an incremental integral feedback signal. The increment proportional and integral feedback signals are added together (step 140) to form an incremental composite proportional/integral feedback signal, and the result is added to the previous value of the feedback variable FV (step 145) to form the present value of FV. Note that the incremental proportional and integral feedback signals could either be positive or negative depending on the actual previous and present values of ES, and therefore the feedback variable FV could likewise be either positive or negative.

Desired fuel signal Fd which was previously calculated for open-loop fuel delivery (step 102), is then trimmed by feedback variable FV. More specifically, signal Fd is divided by the sum of feedback variable FV plus unity (step 150). Accordingly, liquid fuel delivered to engine 28 is adjusted or trimmed by a feedback variable generated from a combined emission signal which specifically defines the operating window for peak conversion efficiency of catalytic converter 50.

Figure 4:
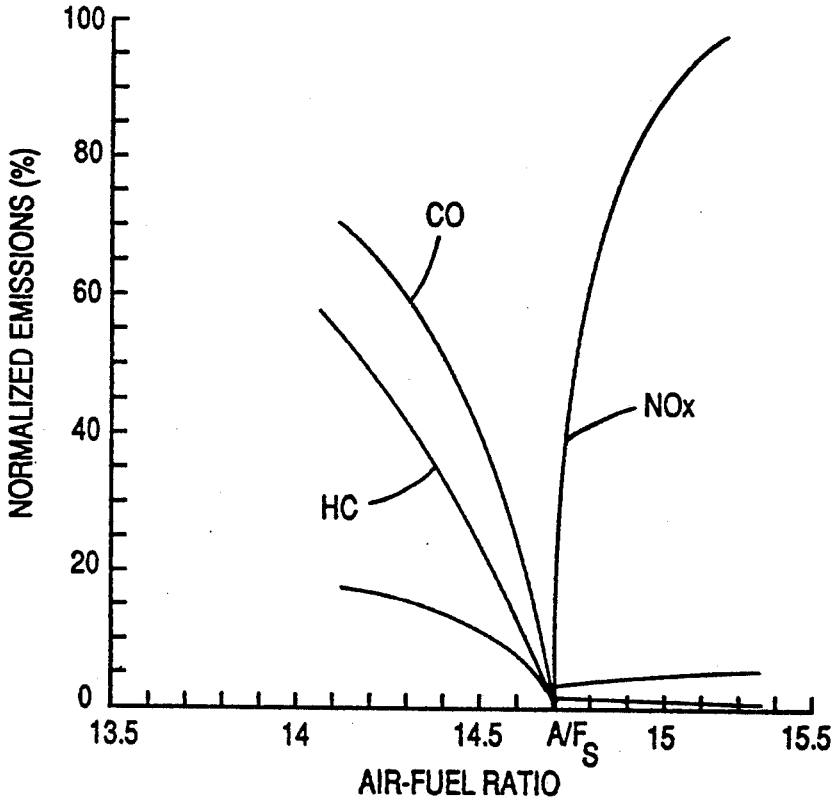
FIG. 4 is a graphical representation of normalized emissions passing through a catalytic converter as a function of engine air/fuel operation.

An example of operation for the above described air/fuel control system is shown graphically in FIG. 4. More specifically, normalized measurements of HC, CO, and NOx emissions from catalytic converter 50 are plotted as a function of air/fuel ratio. Maximum conversion efficiency is shown when the air/fuel ratio is increasing in a lean direction, at the point when CO and HC emissions have fallen near zero, but before NOx emissions have begun to rise. Similarly, while the air/fuel ratio is decreasing, maximum conversion efficiency is achieved when nitrogen oxide emissions have fallen near zero, but CO and HC emissions have not yet begun to rise.

In accordance with the above described operating system, the operating window of catalytic converter 50 will be maintained at the zero crossing point of emissions signal ES regardless of the reference air/fuel ratio.

An example of operation has been presented wherein emission signal ES is generated by subtracting the output of a nitrogen oxide sensor from a combined HC/CO sensor and thereafter fed into a proportional plus integral controller. The invention claimed herein, however, may be used to advantage with other than proportional plus integral controllers. Further, the invention may be used to advantage with the use of separate HC and CO sensors or the use of either a CO or a HC sensor in conjunction with a nitrogen oxide sensor. And, the invention may be used to advantage by combining the sensor outputs by signal processing means other than simple subtraction. Accordingly, the inventors herein intend that the invention be defined only by the following claims.

What is claimed:

1. An engine control system for optimizing conversion efficiency of a catalytic converter positioned in the engine exhaust, comprising:

a first sensor positioned downstream of the catalytic converter for providing a first electrical signal having an amplitude related to quantity of nitrogen oxides in the exhaust;

a second sensor positioned downstream of the catalytic converter for providing a second electrical signal having an amplitude related to quantity of both carbon monoxide and hydrocarbons in the exhaust; and fuel control means for delivering fuel to the engine in relation to quantity of air inducted into the engine and a desired air/fuel ratio and a feedback variable derived by subtracting said first electrical signal from said second electrical signal.

2. The control system recited in claim 1 wherein said fuel control means provides said feedback variable by multiplying said difference between said first electrical signal and said second electrical signal by a proportional term.

3. The control system recited in claim 1 wherein said fuel control means provides said feedback variable by integrating said difference between said first electrical signal and said second electrical signal.

4. An engine control method for optimizing conversion efficiency of a catalytic converter positioned in the engine exhaust, comprising the steps of:

measuring nitrogen oxide content of exhaust gases downstream of the catalytic converter and normalizing said measurement with respect to at least engine speed to generate a first measurement signal;

measuring combined hydrocarbon and carbon monoxide content in exhaust gases downstream of the catalytic converter and normalizing said measurement with respect to at least engine speed to generate a second measurement signal;

subtracting said first measurement signal from said second measurement signal to generate a correction signal;

delivering fuel to the engine in response to an indication of airflow inducted into the engine and a reference air/fuel ratio; and correcting said fuel delivered to the engine by said correction signal to maintain maximum conversion efficiency of the catalytic converter.

5. The method recited in claim 4 wherein said correcting step further comprises the step of integrating said correction signal.

6. The method recited in claim 5 wherein said correcting step further comprises the step of dividing said indication of inducted airflow by said integrated correction signal.

7. An engine control method for optimizing conversion efficiency of a catalytic converter positioned in the engine exhaust, comprising the steps of:

delivering liquid fuel to the engine in relation to a ratio of a measurement of inducted airflow to a desired air/fuel ratio;

subtracting a measurement of nitrogen dioxide passed through the catalytic converter from a combined measurement of hydrocarbons and carbon monoxide passed through the catalytic converter to generate a correction signal having a zero crossing point corresponding to maximum converter efficiency of the catalytic converter; and correcting said liquid fuel delivered in relating to a deviation in said correction signal from said zero crossing point.

* * * * *